US006512499B1

(12) United States Patent
Abe

(10) Patent No.: US 6,512,499 B1
(45) Date of Patent: Jan. 28, 2003

(54) FLAT PLASMA DISCHARGE DISPLAY DEVICE

(75) Inventor: Hironobu Abe, Kanagawa (JP)

(73) Assignee: Sony Corporation (JP)

( * ) Notice: Subject to any disclaimer, the term of this patent is extended or adjusted under 35 U.S.C. 154(b) by 203 days.

(21) Appl. No.: 09/634,634

(22) Filed: Aug. 8, 2000

(30) Foreign Application Priority Data

Aug. 16, 1999 (JP) ..... 11-229867

(51) Int. Cl.[7] ..... G09G 3/28

(52) U.S. Cl. ..... 345/60; 345/62; 345/63; 345/66; 345/67; 345/68

(58) Field of Search ..... 345/60, 61, 62, 345/63, 66, 67, 68

(56) References Cited

U.S. PATENT DOCUMENTS

| | | | | |
|---|---|---|---|---|
| 3,801,851 A | | 4/1974 | Andoh et al. | 313/220 |
| 4,562,434 A | * | 12/1985 | Amano | 315/169.4 |
| 5,661,501 A | * | 8/1997 | Tanamachi | 313/234 |
| 5,744,909 A | * | 4/1998 | Amano | 313/250 |
| 5,907,311 A | * | 5/1999 | Yano | 313/1 |
| 5,966,107 A | * | 10/1999 | Amemiya | 315/169.4 |
| 6,326,727 B1 | * | 12/2001 | Chung | 313/585 |

FOREIGN PATENT DOCUMENTS

| | | |
|---|---|---|
| EP | 920048 | 6/1999 |
| JP | 1-137537 | 5/1989 |
| JP | 4-181633 | 6/1992 |
| JP | 5-101781 | 4/1993 |
| JP | 7-182979 | 7/1995 |
| JP | Hei 7/220641 | 8/1995 |

* cited by examiner

*Primary Examiner*—Richard Hjerpe
*Assistant Examiner*—Duc Q. Dinh
(74) *Attorney, Agent, or Firm*—Rader, Fishman, & Grauer PLLC; Ronald P. Kananen, Esq.

(57) ABSTRACT

A flat plasma discharge display device comprises a first substrate 1 and second substrate 2 which are provided opposite to each other, and address electrode group 13 having a plurality of address electrodes A arranged in parallel, a first discharge maintaining electrode group 11 having a plurality of first discharge maintaining electrodes S1 arranged in parallel, and a second discharge maintaining electrode group 12 having a plurality of second discharge maintaining electrodes S2 arranged in parallel. The first discharge maintaining electrodes S1, the second discharge maintaining electrodes S2 and the address electrodes A have main directions of extension thereof which are selected to be first and second directions intersecting each other. Consequently, a numerical aperture can be increased.

9 Claims, 6 Drawing Sheets

FLAT PLASMA DISCHARGE DISPLAY DEVICE

BACKGROUND OF THE INVENTION

1. Field of the Invention

The present invention relates to a flat plasma discharge display device using an AC plasma discharge.

2. Description of the Related Art

For example, Japanese Laid-Open Patent Publication No. Hei 7-220641 has disclosed a flat display device utilizing a plasma discharge.

As an example of a conventional flat display device of this kind, for example, FIG. 6 is a schematic perspective view showing a part cut away, and FIG. 7 is a schematic exploded perspective view showing a flat vessel in which first and second substrates 101 and 102 formed of a glass substrate, for example, are opposed to each other with a needed space held therebetween and the surroundings are sealed with airtightness.

A discharge maintaining electrode group 105 is provided on the internal surface of the first substrate 101, in which plural pairs of first and second discharge maintaining electrodes 103 and 104 are formed of transparent conductive layers making a pair, for example, and are arranged in parallel (only one pair is shown in the drawing).

The discharge maintaining electrodes 103 and 104 formed of the transparent conductive layers have high resistivities and so-called bus electrodes 103*b* and 104*b* formed of metal layers having high conductivities are bonded along the side edge opposed to the opposed sides of the discharge maintaining electrodes 103 and 104 making each pair.

Partition walls 106 extended in a direction orthogonal to the directions of extension of the discharge maintaining electrodes 103 and 104 are provided with a predetermined space in parallel and an address electrode group 108 is provided with a stripe-shaped address electrode 107 formed between the partition walls 106 on the internal surface of the second substrate 102. In addition, phosphors R, B and B for emitting red, green and blue colors, for example, by excitation with ultraviolet rays generated through a plasma discharge are coated between the partition walls 106.

FIG. 8 is a view showing the planar arrangement relationship among the first and second discharge maintaining electrodes 103 and 104, the address electrode 107 and the partition wall 106.

The driving operation of the flat plasma discharge display device having the above-mentioned structure applies a needed discharge starting voltage between the address electrode 107 and the first discharge maintaining electrode 103 which are selected respectively, thereby accumulating electric charges in a portion intersecting them and starting a discharge through a high-frequency discharge phenomenon. In this state, a needed alternating voltage is applied between the discharge maintaining electrode 103 and the second discharge maintaining electrode 104 making a pair therewith so that a plasma is generated in a discharge space in this portion and electric charges are accumulated at the same time, thereby continuing the discharge, that is, maintaining the discharge. The phosphors R, G and B having respective colors described above which are positioned in the intersecting portion are caused to emit light with ultraviolet rays generated through the discharge.

In this case, a region enclosed with a solid line a in the intersecting portion of the address electrode 107 and the discharge maintaining electrodes 103 and 104 making a pair almost acts as a discharge region and a region shown in a slant line almost acts as a light emitting region for the phosphor, that is, a pixel region 110 as typically illustrated in FIG. 8, for example. With this structure, the centers of the pixel region and the discharge region are almost coincident with each other.

SUMMARY OF THE INVENTION

While the flat plasma discharge display device has been put into practical use, the luminance thereof is insufficient. For example, the luminance in the display panel of the flat plasma discharge display device of this type having a 42 inch screen is approximately 500 cd/m$^2$.

In a finally completed display device using this panel, a sheet or a film for electromagnetic wave shielding and the prevention of external light reflection is overlapped with the display panel. Therefore, the brightness actually observed is reduced very much.

For example, in a so-called reflection type flat plasma discharge display device in which an image is observed on the first substrate 101 side provided with the first and second discharge maintaining electrodes 103 and 104 opposite to the second substrate 102 side provided with the phosphor and the address electrode 107 described above, the light emitting display is observed through the discharge maintaining electrodes 103 and 104. Therefore, it is necessary to constitute them by transparent electrodes. Moreover, even if they are constituted by the transparent electrodes, bus electrodes 103*b* and 104*b* are provided thereof so that light shielding is increased in a light emitting portion. Furthermore, even if the discharge maintaining electrodes are constituted by the transparent electrodes, light absorption caused during passage through the transparent electrodes cannot be ignored.

As shown in FIG. 8, furthermore, the centers of the discharge region 109 and the pixel region 110 are almost coincident with each other. Therefore, when a shielding layer for shielding the external emission of unnecessary electromagnetic waves and ultraviolet rays generated in the discharge region 109 is provided, original light emission for display also is reduced.

The above-mentioned matter causes a luminance in the completed flat plasma discharge display device to be reduced.

The present invention provides a flat plasma discharge display device capable of effectively avoiding such drawbacks to obtain bright display.

In the flat plasma discharge display device according to the present invention, a first substrate and a second substrate are provided opposite to each other, a peripheral portion thereof is sealed with airtightness through a frit seal, for example, and a flat airtight space is formed between the first and second substrates.

DESCRIPTION OF THE PREFERRED EMBODIMENTS

Figure 1:
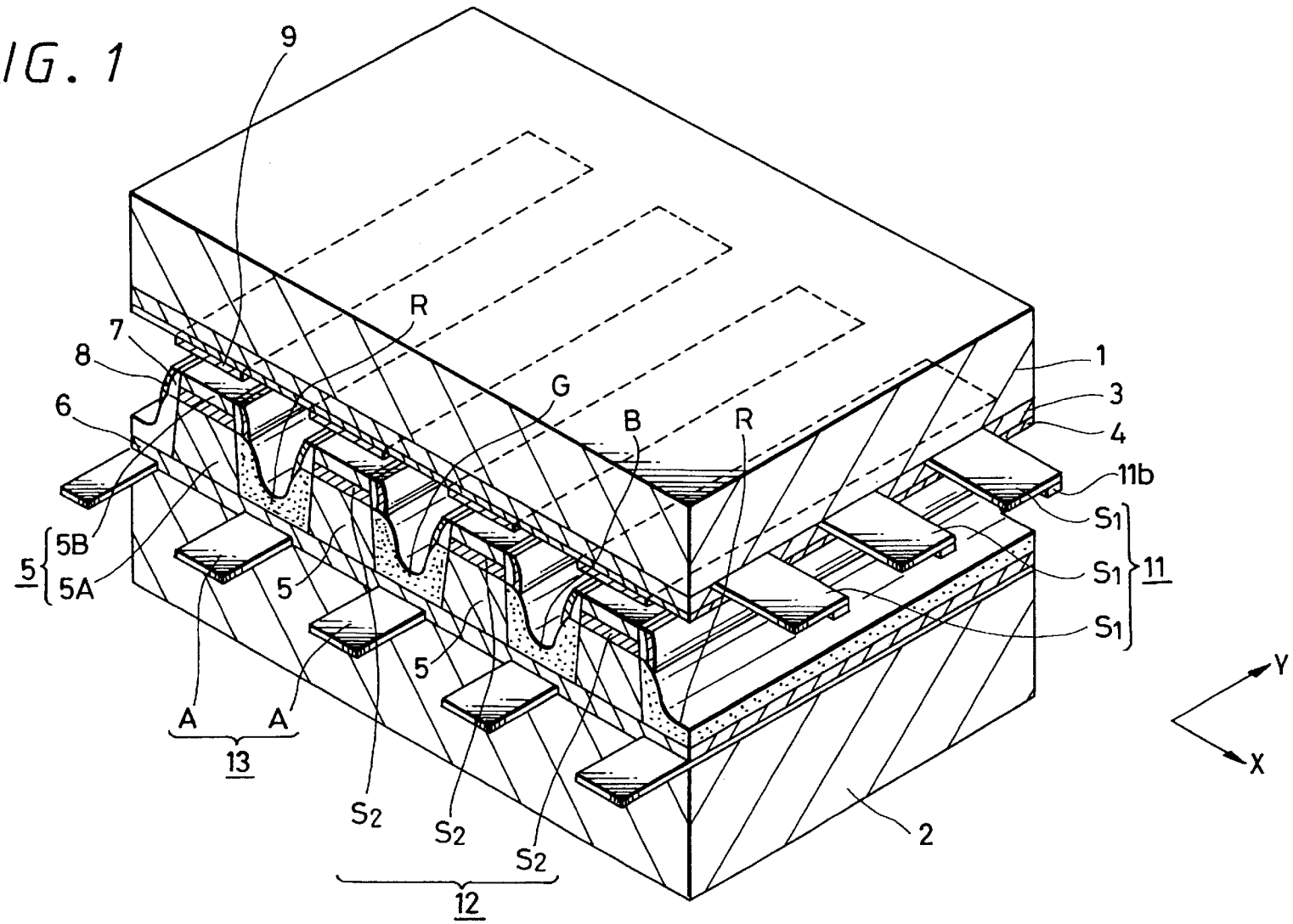
FIG. 1 is a partially exploded perspective view showing an example of a flat plasma discharge display device according to the present invention.

The flat plasma discharge display device comprises an address electrode group having a plurality of address electrodes arranged in parallel, a first discharge maintaining electrode group having a plurality of first discharge maintaining electrodes arranged in parallel, and a second discharge maintaining electrode group having a plurality of second discharge maintaining electrodes arranged in parallel, the second discharge maintaining electrodes carrying out a discharge maintaining operation between the first discharge maintaining electrodes.

The first discharge maintaining electrode group is formed on the first substrate side, the address electrode group is formed on the second substrate side, the second discharge maintaining electrode group is formed on the first substrate side or the second substrate side, the first discharge maintaining electrode and the second discharge maintaining electrode are provided opposite to each other through at least a dielectric layer, and the first discharge maintaining electrode and the second discharge maintaining electrode have main directions of-extension thereof that are selected to be first and second directions intersecting each other.

As described above, in the flat plasma discharge display device according to the present invention, the first and second discharge maintaining electrodes constituting a pair of discharge maintaining electrodes are caused to intersect each other. Consequently, one of the discharge maintaining electrodes gets out of the center of a pixel region. Thus, a substantial numerical aperture can be increased so that a bright display can be obtained.

Moreover, at least the central positions of the discharge region and the pixel region can be shifted. Consequently, a shielding layer for unnecessary electromagnetic waves and unnecessary ultraviolet rays does not need to be provided over the whole pixel region or at least a part thereof. Thus, a brighter display can be obtained.

An example of an embodiment of a flat plasma discharge display device according to the present invention will be described with reference to the partially exploded perspective view of FIG. 1. However, the device according to the present invention is not restricted to this example.

In the flat plasma discharge display device, first and second substrates 1 and 2 formed of a glass substrate, for example, are opposed to each other with a needed space and the surroundings thereof are sealed airtightly with a frit seal, for example, thereby constituting a flat vessel, which is not shown.

In this example, a light emitting display is observed on the first substrate 1 side. In this case, at least the first substrate 1 is constituted by a transparent glass substrate through which display light is transmitted.

A first discharge maintaining electrode group 11 having a large number of first discharge maintaining electrodes $S_1$ arranged in parallel is formed on the first substrate 1 side.

These first discharge maintaining electrodes $S_1$ can be constituted by a transparent conductive layer, for example, ITO (indium tin oxide) which is bonded to the internal surface of the first substrate 1 directly or indirectly through an insulating layer, an insulating substrate or the like, for example. These first discharge maintaining electrodes $S_1$ are arranged in parallel like a stripe, for example, which is extended in a first direction (hereinafter referred to as an X direction) along the substrate plane of the substrate 1, with mutual needed spaces held therebetween.

A dielectric layer 3 such as SiO2 is bonded onto the whole surface, for example, where the first discharge maintaining electrode group 11 is to be provided, and a surface layer 4 formed of MgO, for example, having a small work function or (and) a high secondary electron emission ratio and a sputtering proof property is provided over the dielectric layer 3.

Moreover, a shielding film 9 formed of a metallic thin film, an ITO film, a metal mesh or the like, for example, which can efficiently shield the external discharge of unnecessary electromagnetic waves and ultraviolet rays corresponding to a partition wall 5 to be described below is bonded like a stripe onto the surface layer 4 of the first substrate 1, for example.

A second discharge maintaining electrode group 12 having a plurality of second discharge maintaining electrodes $S_2$ arranged in parallel, an address electrode group 13 having a plurality of address electrodes A arranged in parallel and a plurality of stripe-shaped partition walls 5 arranged in parallel are formed on the second substrate 2 side.

The address electrode A is formed on the second substrate 2 with a stripe-shaped metal layer such as Al, Ag, Cu, Ni, Cr or the like having a high conductivity extended in a second direction (hereinafter referred to as a Y direction) intersecting the X direction described above, for example, orthogonal thereto and arranged in parallel at mutual predetermined intervals directly or indirectly through an insulating layer or an insulating substrate.

A dielectric layer 6 comprised of SiO2 or the like is wholly formed over the address electrodes A, that is, the address electrode group 13, and a stripe-shaped insulating partition wall 5 extended in the Y direction is mutually arranged on the dielectric layer 6 in parallel corresponding to the portions in which each address electrode A is provided.

A second discharge maintaining electrode $S_2$ is formed on the partition wall 5 in the direction of extension of the partition wall 5, that is, in the Y direction.

In the example shown in FIG. 1, the stripe-shaped second discharge maintaining electrode $S_2$ formed of a metal layer such as Al, Ag, Cu, Ni or Cr having such a material and thickness as to require no light transmitting property and an excellent conductive property is provided in the partition wall apart from the top surface of the partition wall 5 at a needed distance.

A dielectric layer 7 comprised of SiO2 or the like is formed on the side surface of the partition wall 5 which both side edges of the stripe-shaped second discharge maintaining electrode $S_2$ face, and the same surface layer 8 as the above-mentioned surface layer 4 which is comprised of MgO, for example, is bonded onto the dielectric layer 7.

Phosphors R, G and B for emitting light having red, green and blue colors, for example, through ultraviolet excitation are arranged sequentially and coated in a trench between the partition walls 5 in the direction of extension of the trench.

Figure 2:
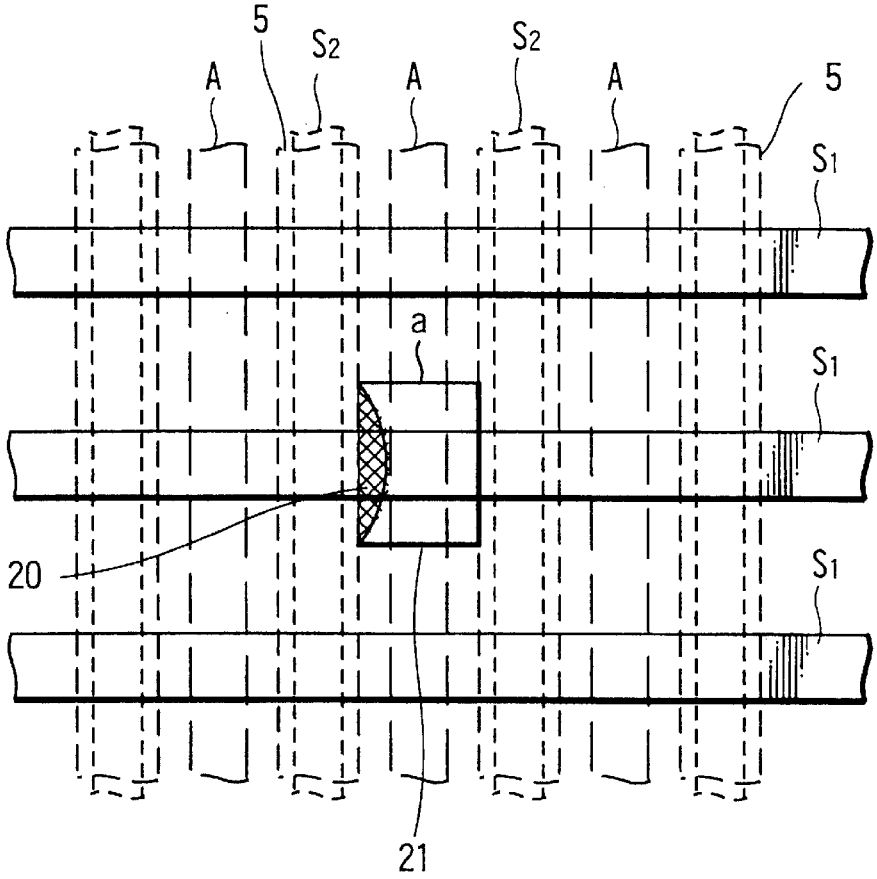
FIG. 2 is a plan view showing the arrangement of electrodes of the flat plasma discharge display device according to the present invention.

The planar arrangement relationship among the first and second discharge maintaining electrodes $S_1$ and $S_2$, the address electrode A and the partition wall 5 in the flat plasma discharge display device having the structure of the present invention is shown in FIG. 2.

Thus, the first and second substrates 1 and 2 are opposed with a needed space held through the partition wall 5.

At the same time, the space between the electrodes making a pair during the discharge maintenance of the first and second discharge maintaining electrodes $S_1$ and $S_2$, that is, the space in a portion contributing to the discharge maintenance in the mutual intersecting portion is set through the partition wall 5, the selection of the arrangement position of the second discharge maintaining electrode $S_2$ in the partition wall 5 and the like. In FIG. 1, the space between both side edges of the stripe-shaped second discharge maintaining electrode $S_2$ and the first discharge maintaining electrode $S_1$ is set to a predetermined space. The space is set to 50 $\mu$m or less, preferably 20 $\mu$m or less, for example, 10 $\mu$m.

Furthermore, the space between the address electrode A and the first discharge maintaining electrode $S_1$ is simultaneously set to be 100 $\mu$m or more, for example, 130 $\mu$m.

An airtight space formed by the first and second substrates 1 and 2 is exhausted, and so-called Penning gas comprising a needed gas, for example, one or more of rare gases such as He, Ne, Ar, Xe, Kr and the like, for example, an optimized mixed gas of Ne and Xe is filled therein.

The gas is filled at such a pressure as to stably maintain a discharge having a high luminance and efficiency in relation to the space between the address electrode A and the discharge maintaining electrodes $S_1$ and $S_2$ .

In the driving operation of the flat plasma discharge display device, for example, a reset period, an address period and a sustain (discharge maintaining) period are provided, a needed discharge starting voltage is applied between the address electrode A and the first discharge maintaining electrode $S_1$ selected for the address period to accumulate electric charges in a portion in which they intersect each other, and the discharge is caused to rise through a high-frequency discharge phenomenon, that is, a discharge is started. For the next sustain period, a needed alternating voltage is applied between the first and second discharge maintaining electrodes $S_1$ and $S_2$, thereby generating a plasma during a discharge space in this portion and accumulating the electric charges to continue, that is, maintain the discharge at the same time. The phosphors R, G and B having the respective colors described above corresponding to the intersecting portion are caused to emit light through ultraviolet rays generated by the discharge.

In this case, a space between the address electrode A and the first discharge maintaining electrode $S_1$ is selected to be 100 $\mu$m or more, for example. Therefore, the discharge therebetween, that is, the discharge for discharging start generates a so-called negative glow discharge.

Referring to the discharge maintenance, the space between the first and second maintaining electrodes is selected to be 50 $\mu$m or less, preferably, 20 $\mu$m or less, for example, 10 $\mu$m. Consequently, this discharge is carried out mainly through a cathode glow discharge.

Thus, in the case in which the same power as that in the conventional art is put through the cathode glow discharge, the discharge efficiency and the ultraviolet ray generation efficiency can be enhanced. Moreover, in the case in which a luminance equal to or higher than that of the negative glow discharge is to be obtained, the discharge maintaining voltage can be reduced.

In the above-mentioned flat plasma discharge display device according to the present invention, as typically illustrated in FIG. 2, a discharge region 20 is provided in the vicinity of the side edge of the second discharge maintaining electrode $S_2$ of the intersecting portion of the first and second discharge maintaining electrodes $S_1$ and $S_2$ shown in a chain line between the partition walls 5, and a light emitting region, that is, a pixel region 21 is provided on the address electrode A coated with a phosphor between the partition walls 5 enclosed with a solid line a. Accordingly, at least the centers of the discharge region 20 and the pixel region 21 are shifted from each other.

Accordingly, a shielding film 9 for shielding unnecessary electromagnetic waves and ultraviolet rays that are generated from a discharge portion provided on the first substrate 1 side can be formed with such a position and width as to rarely cover the pixel region 21.

In the example shown in FIG. 1, the second discharge maintaining electrode $S_2$ is provided with both side edges thereof facing the side surface of the partition wall 5. As illustrated in a sectional view showing a main part in FIG. 3, in the case in which the second discharge maintaining electrode $S_2$ is to be buried in the partition wall 5 and both side edges thereof are to be provided so as not to face the side surface of the partition wall 5, the partition wall 5 itself acts as a dielectric layer and the formation of the dielectric layer 7 in FIG. 1 can be omitted.

Figure 4:
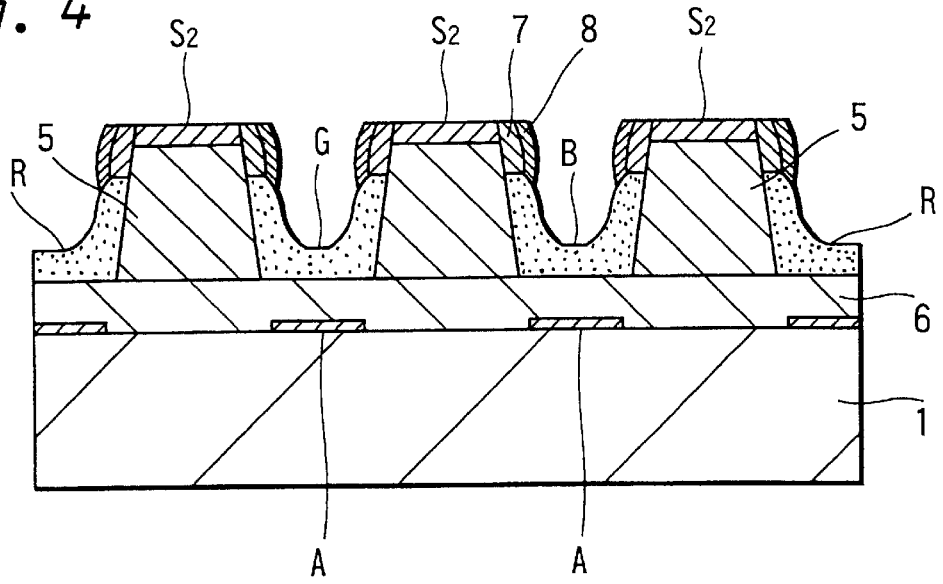
FIG. 4 is a sectional view showing a main part of yet another example of the flat plasma discharge display device according to the present invention.
Figure 8:
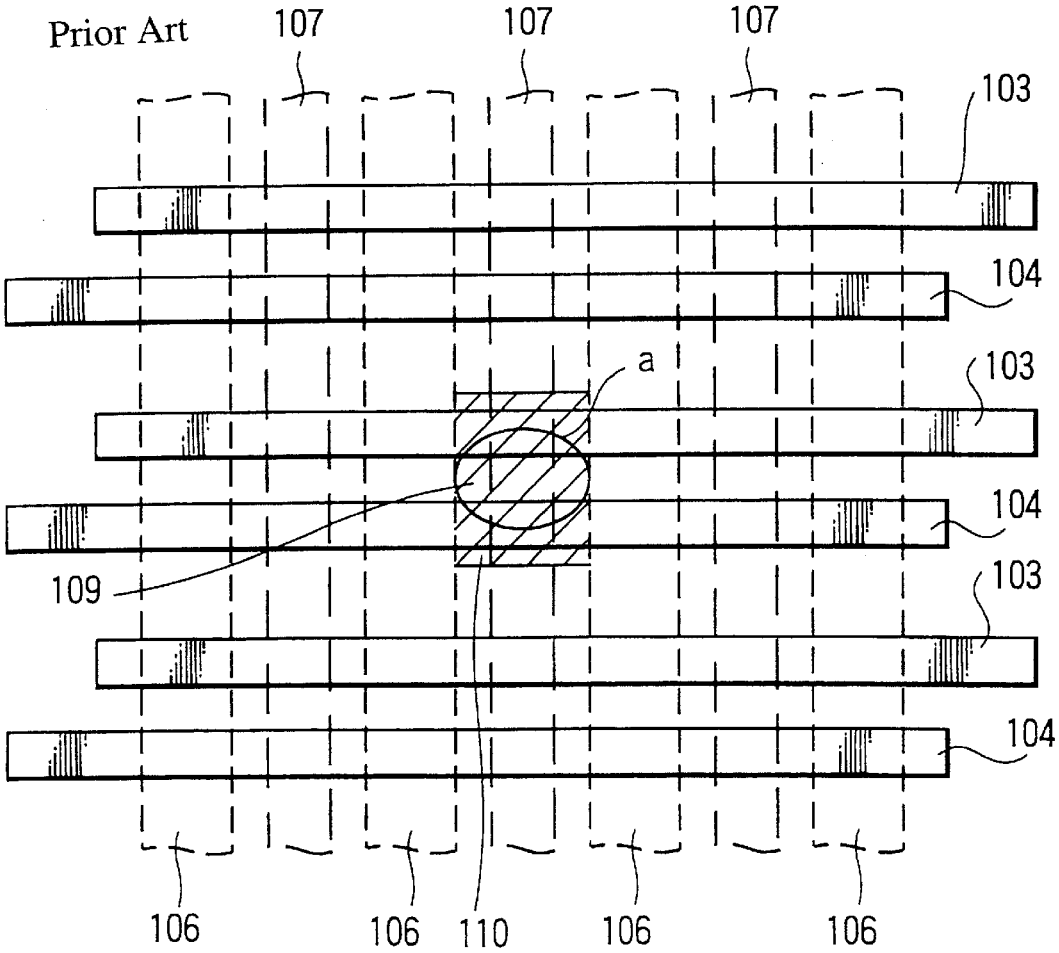
FIG. 8 is a plan view showing the arrangement relationship between the electrodes and the like in the conventional flat plasma discharge display device.

Alternatively, the second discharge maintaining electrode $S_2$ can be provided on the top surface of the partition wall 5 as illustrated in the sectional view showing a main part in FIG. 4.

Figure 3:
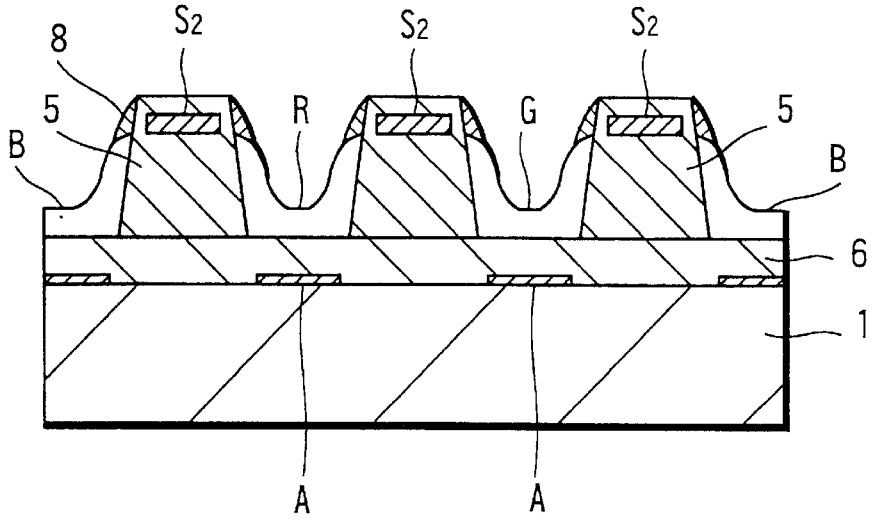
FIG. 3 is a sectional view showing a main part of another example of the flat plasma discharge display device according to the present invention.

In FIGS. 3 and 4, corresponding portions to those of FIG. 1 have the same reference numerals and repetitive description thereof will be omitted.

It is possible to employ various arrangement structures in which the second discharge maintaining electrode $S_2$ is provided along the side surface of the partition wall 5, which is not shown.

In the above-mentioned example, the first discharge maintaining electrode $S_1$ is formed on the first substrate 1 side and the second discharge maintaining electrode $S_2$ is formed on the second substrate 2 side. As another embodiment, for example, the first and second discharge maintaining electrodes $S_1$ and $S_2$ can be provided together on the first substrate 1 side as shown in a partially exploded perspective view illustrating the example in FIG. 5.

Figure 5:
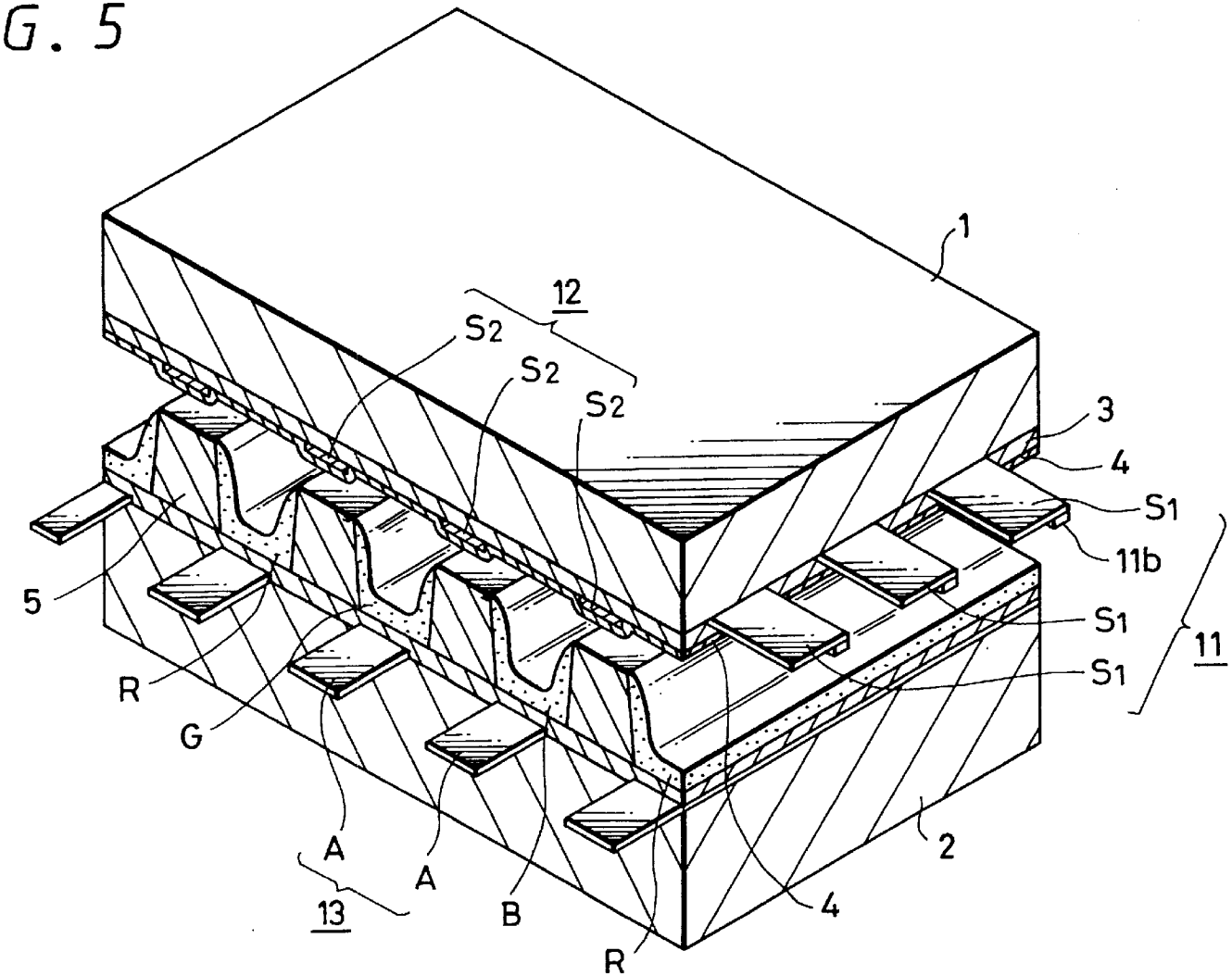
FIG. 5 is an exploded perspective view showing a main part of a further example of the flat plasma discharge display device according to the present invention.
Figure 6:
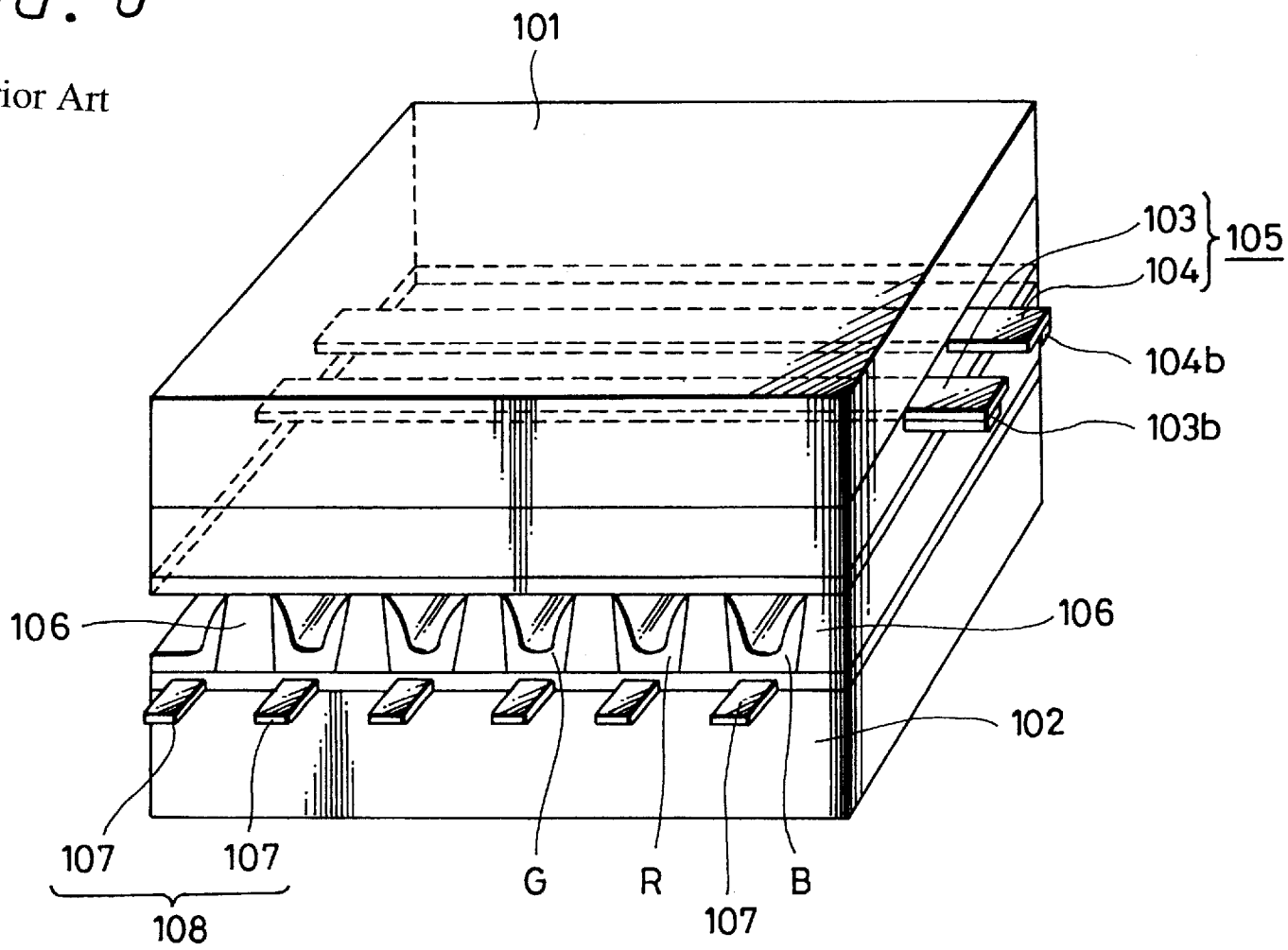
FIG. 6 Prior Art
FIG. 6 is a perspective view showing a part of a conventional flat plasma discharge display device.
Figure 7:
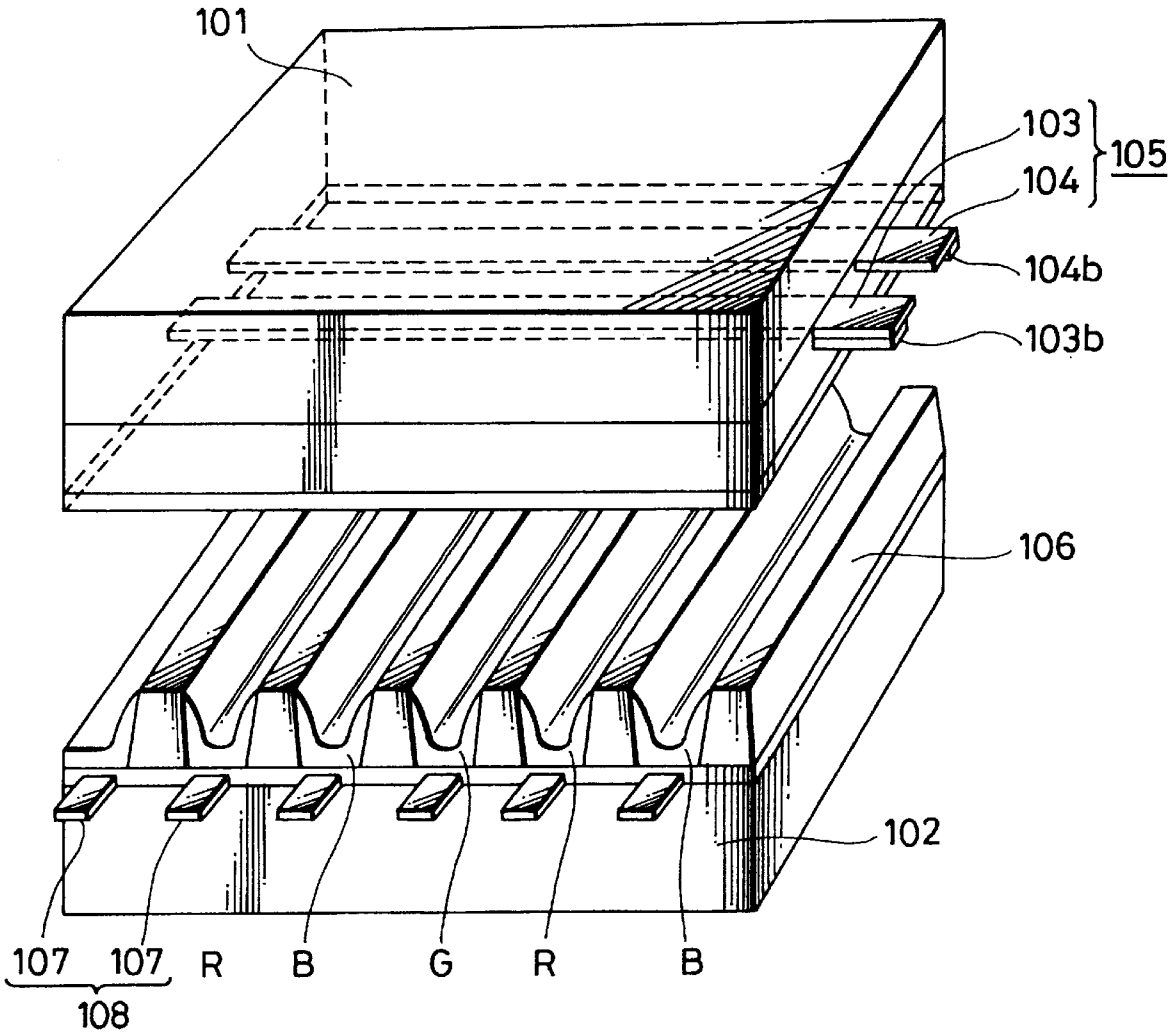
FIG. 7 Prior Art
FIG. 7 is a partially exploded perspective view showing the conventional flat plasma discharge display device.

In FIG. 5, corresponding portions to those of FIG. 1 have the same reference numerals and repetitive descriptions thereof will be omitted. In this case, after the first discharge maintaining electrode $S_1$ is formed on the first substrate 1 in the same manner as that in FIG. 1, an insulating layer, that is, a dielectric layer 3 is wholly formed, for example, and the stripe-shaped second discharge maintaining electrode $S_2$ then is formed on the dielectric layer 3 in a position opposite to the partition wall 5, that is, in the Y direction in an electrical insulating state from the first discharge maintaining electrode $S_1$. Alternatively, the first discharge maintaining electrode $S_1$ also can be formed after the formation of the second discharge maintaining electrode $S_2$.

The above-mentioned surface layer 4 comprised of MgO, for example, is wholly formed over the first and second discharge maintaining electrodes $S_1$ and $S_2$. Also in this case, the thickness of the dielectric layer 3 is selected such that the space in the intersecting portion of the first and second discharge maintaining electrodes $S_1$ and $S_2$ is 50 $\mu$m or less, preferably 20 $\mu$m or less, for example, 10 $\mu$m.

While the dielectric layer 3 is formed wholly over the portion in which the first discharge maintaining electrode $S_1$ is provided, that is, over the whole first discharge maintaining electrode group 11, in each of the example of the above-mentioned embodiments, it also can be formed restrictedly on the first discharge maintaining electrode $S_1$.

As described above, in the flat plasma discharge display device according to the present invention, the first and second discharge maintaining electrodes $S_1$ an $S_2$ are caused to intersect each other. Consequently, the space between the discharge maintaining electrodes $S_1$ of the first discharge maintaining electrode group 11 can be increased.

Accordingly, a bright display can be obtained with an increase in the numerical aperture.

Moreover, the central positions of the discharge region 20 and the pixel region 21 can be shifted from each other. Consequently, a shielding film 9 is formed restrictedly in a region including the discharge region 20 and is not formed in at least a part of the pixel region 21.

Furthermore, the numerical aperture can be increased as described above. Consequently, the space between the first discharge maintaining electrodes $S_1$ and the width thereof can be set to be greater than that in the conventional art. Thus, the dielectric layer 3 to be formed on the first discharge maintaining electrode SI can be subjected to patterning. In other words, the dielectric layer 3 is removed from at least a part of the pixel region 21. As a result, the light derivation rate for external display light emission can be increased so that brighter display can be obtained.

Alternatively, the numerical aperture can be increased as described above. Consequently, the width and thickness of the first discharge maintaining electrode $S_1$ comprised of the transparent conductive layer can be increased with the numerical aperture held to be almost equal to or greater than that in the conventional art. Thus, the electric resistance of the first discharge maintaining electrode $S_1$ can be reduced, and the arrangement of the bus electrode can be omitted or the width thereof can be reduced in some cases. As a result, the brightness can be improved more.

As described above, the space between the discharge maintaining electrodes $S_1$ and $S_2$ is set to 50 $\mu$m or less, preferably 20 $\mu$m, for example, 10 $\mu$m. Consequently, the discharge can be carried out mainly through a cathode glow discharge, the driving power thereof, can reduced the a plasma generation rate, can be enhanced and therefore the ultraviolet ray generation rate can be enhanced as compared with the negative glow discharge. Thus, the light emission luminance can be enhanced. Moreover, it is possible to obtain great effects in power saving, in particular, great power saving effects in a large screen display.

Next, an example of a method of manufacturing the flat plasma discharge display device according to the present invention will be described for the case in which the flat plasma discharge display device having the structure shown in FIG. 1 is obtained.

The first substrate 1 side will be described below. In this case, for example, a glass substrate 1 is prepared and a first discharge maintaining electrode $S_1$ is directly formed on the internal surface of the substrate 1, for example. Referring to the formation of the first discharge maintaining electrode $S_1$, a transparent conductive layer, for example, ITO, tin oxide or the like is formed over the whole internal surface of the substrate 1 by a well-known thin film technique such as sputtering and is subjected to pattern etching through photolithography, for example. Consequently, a plurality of stripe-shaped first discharge maintaining electrode $S_1$ extended in the X direction is arranged in parallel with each other as described above.

As shown in FIG. 1, next, a bus electrode 11*b* is bonded along one side edge of the first discharge maintaining electrode $S_1$, for example.

The bus electrode 11*b* is formed by first forming a metal having a good conductive property such as Ag, Al, Ni, Cu or Cr over the whole discharge maintaining electrode $S_1$ through sputtering or the like and then carrying out pattern etching through photolithography, for example, to have a needed pattern, that is, a pattern having a much smaller width than the width of the discharge maintaining electrode $S_1$ in the direction of the extension of the discharge maintaining electrode $S_1$ over each discharge maintaining electrode $S_i$.

Alternatively, the bus electrode 11*b* having the above-mentioned pattern also can be formed by printing a conductive material to have the needed pattern through screen printing.

Thereafter, a dielectric layer 3 comprised of SiO2, for example, is wholly formed through a CVD (Chemical Vapor Deposition) method or the like, for example. Moreover, the dielectric layer 3 is subjected to pattern etching through photolithography as described above if necessary, thereby removing the dielectric layer 3 in a portion to finally become a pixel region excluding a portion provided over the first discharge maintaining electrode $S_1$, for example.

Subsequently, a surface layer 4 is wholly formed with MgO in a thickness of approximately 0.5 $\mu$m to 1.0 $\mu$m through electron beam deposition, for example.

After or before the surface layer 4 is formed, a shielding film 9 is formed to have the above-mentioned pattern in the above-mentioned predetermined position.

A method of manufacturing a second substrate 2 will be described below.

Also in this case, for example, the second substrate 2 formed of a glass substrate is prepared, and an address electrode A is directly formed on an internal surface thereof. The address electrode A is formed by wholly providing a metal having a good conductive property such as Ag, Al, Ni, Cu or Cr through sputtering in the same manner as the above-mentioned method of forming the bus electrode 11*b*, for example, and then carrying out pattern etching by photolithography, for example, to have the needed pattern, that is, a plurality of striped-shaped patterns extended in the Y direction, for example.

Alternatively, a plurality of address electrodes A having the needed pattern also can be formed by bonding a conductive material to have the needed pattern through screen printing, for example.

Next, a dielectric layer (insulating layer) 6 comprised of SiO2 is formed wholly through the CVD method or the like, and a partition wall 5 having a predetermined height, for example, a height of approximately 100 $\mu$m or more, for example, approximately 150 $\mu$m is formed between the address electrodes A.

In the example shown in FIG. 1, the partition wall 5 is constituted by a partition wall body 5A and an insulating layer 5B formed thereon, and a second discharge maintaining electrode $S_2$ is formed therebetween.

In this case, the partition wall body 5A is first formed. The formation can be carried out by repeating a work for performing printing in a needed pattern using a glass paste, for example, and drying the same. Alternatively, the glass paste is wholly applied in a needed thickness and is dried, a mask formed of a photoresist layer is formed thereon, for example, and a portion that is not covered with the mask is removed through sand blasting. Consequently, the partition wall body 5A also can be formed.

Then, a metal having a good conductive property such as Ag, Al, Ni, Cu or Cr is wholly formed through sputtering or the like, for example, and other portions are removed by pattern etching through photolithography, for example, with a metal layer left on the partition wall body 5A. Thus, the second discharge maintaining electrode $S_2$ is formed.

Next, $SiO_2$ or the like is formed to cover the discharge maintaining electrode $S_2$ through the sputtering or the like. Thus, an insulating layer 5B, and furthermore, a dielectric layer 6 are formed at the same time, for example.

Then, phosphors R, G and B having respective colors are formed in every two trench portions between the partition walls 5 in needed order by using a photosensitive fluorescent slurry in the procedure of coating and exposure or by printing.

Next, the above-mentioned surface layer 8 comprised of MgO, for example, is formed from above both side surface sides of the partition wall 5 through oblique deposition.

Thus, the first and second substrates 1 and 2 having respective electrodes formed thereon are opposed to each other such that the direction of extension of each of the first discharge maintaining electrode $S_1$ and that of extension of each of the second discharge maintaining electrodes $S_2$ are orthogonal to each other, the address electrode A and the partition wall 5 intersect each other, for example, and the peripheral portions of both substrates are sealed with air-tightness through a frit seal or the like.

Then, the space formed between the first and second substrates 1 and 2 is exhausted through a vent port provided in the sealed portion, and the vent port is sealed through the introduction of the needed gas described above.

Moreover, at least one side edge of the first and second substrates 1 and 2 is protruded from the other substrates 2 and 1 and is lead externally, and the end of the first discharge maintaining electrode $S_1$ and the ends of the second discharge maintaining electrode $S_2$ and the address electrode A are led to the side edges and act as power supply terminals, respectively.

In the example of the manufacturing method described above, the flat plasma discharge display device shown in FIG. 1 is obtained. In the case in which the flat plasma discharge display device according to the embodiment shown in FIG. 5, that is, the first and second discharge maintaining electrodes $S_2$ are to be formed on the first substrate 1 side, the first discharge maintaining electrode $S_1$ is formed, the dielectric layer 3 is formed, and the second discharge maintaining electrode $S_2$ is then formed thereon in the manufacturing process on the first substrate 1 side described above. The second discharge maintaining electrode $S_2$ can be provided by wholly forming a metal having a good conductive property such as Ag, Al, Ni, Cu or Cr through the sputtering or the like and carrying out pattern etching through photolithography, for example.

In this case, the step of forming of the second discharge maintaining electrode $S_2$, the formation of the insulating layer 5B and the like can be omitted in the manufacturing process on the second substrate 2 side.

The flat plasma discharge display device and the method of manufacturing the same according to the present invention are not restricted to the above-mentioned example but can be variously changed and modified.

As described above, in the flat plasma discharge display device according to the present invention, the first and second discharge maintaining electrodes $S_1$ and $S_2$ are caused to intersect each other. Consequently, the space between the respective first discharge maintaining electrodes $S_1$ can be increased.

Accordingly, the numerical aperture can be increased so that a bright display can be obtained.

Moreover, the discharge region and the pixel region are shifted from each other. Consequently, it is possible to obtain such a structure that the shielding film for shielding the external emission of unnecessary electromagnetic waves and ultraviolet rays is formed in a restricted position and is not formed on at least a part of the pixel region. Thus, a brighter display can be obtained.

Furthermore, the numerical aperture can be increased. Consequently, the space and width of the first discharge maintaining electrode can be set to be greater than that of the conventional art. Thus, the dielectric layer to be formed on the first discharge maintaining electrode can be subjected to patterning, and furthermore, the attenuation of the display light emission can be prevented from being caused by the presence of the dielectric layer, resulting in a brighter display.

As described above, the numerical aperture can be increased. Consequently, the width and thickness of the first discharge maintaining electrode $S_1$ formed of the transparent conductive layer can be increased with the numerical aperture held to be equal to or greater than that of the conventional structure. Thus, the electric resistance of the first discharge maintaining electrode can be reduced and the arrangement of the bus electrode can be omitted or the width can be reduced. The brightness can be improved more.

As described above, the space between the first and second discharge maintaining electrodes is set to 50 $\mu$m or less, preferably 20 $\mu$m, for example, 10 $\mu$m. Consequently, the discharge can be carried out mainly through the cathode glow discharge. The discharge can reduce the driving power thereof more greatly than the negative glow discharge. In the case in which power equivalent to that of the negative glow discharge is put, the plasma generation ratio, that is, the ultraviolet ray generation ratio can be enhanced. Consequently, the light emission luminance can be enhanced. Moreover, it is possible to produce a power savings, in particular, great power saving effects for a large screen display with the cathode glow discharge. By such a reduction in the driving power, heat radiating means, for example, a heat radiating fan can be omitted or the size or number of heating fans can be reduced or the number and size of heat radiating fins can be reduced. Thus, the weight of the flat plasma discharge display device can be reduced.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. A flat plasma discharge display device comprising;

a first substrate and a second substrate which are provided opposite to each other;

an address electrode group having a plurality of address electrodes arranged in parallel;

a first discharge maintaining electrode group having a plurality of first discharge maintaining electrodes arranged in parallel; and a second discharge maintaining electrode group having a plurality of second discharge maintaining electrodes arranged in parallel, the second discharge maintaining electrodes carrying out a discharge maintaining operation between the first discharge maintaining electrodes;

the first discharge maintaining electrode group being formed on the first substrate side, the address electrode group being formed on the second substrate side, the second discharge maintaining electrode group being formed on the first substrate side or the second substrate side, the first discharge maintaining electrodes and the second discharge maintaining electrodes being provided opposite to each other through at least a dielectric layer; and the first discharge maintaining electrodes and the second discharge maintaining electrodes having main directions of extension thereof which are selected to be first and second directions intersecting each other.

2. The flat plasma discharge display device according to claim 1, wherein a discharge between the first and second discharge maintaining electrodes is mainly carried out through a cathode glow discharge.

3. The flat plasma discharge display device according to claim 1, wherein a distance between the first and second discharge maintaining electrodes for discharge maintenance is set to 50 $\mu$m or less and the discharge maintenance is mainly carried out through a cathode glow discharge.

4. The flat plasma discharge display device according to claim 1, wherein the first discharge maintaining electrodes are formed of a transparent electrode.

5. The flat plasma discharge display device according to claim 1, wherein the address electrodes are provided corresponding to the second discharge maintaining electrodes, and a main direction of extension of the address electrodes are selected to be almost the second direction.

6. The flat plasma discharge display device according to claim 1, wherein a plurality of partition walls extended in the second direction are arranged in parallel between the first and second substrates and the second discharge maintaining electrodes are provided on the partition wall.

7. The flat plasma discharge display device according to claim 1, wherein a plurality of partition walls extended in the second direction are arranged in parallel between the first and second substrates and the address electrodes are provided between the adjacent partition walls.

8. The flat plasma discharge display device according to claim 1, wherein a plurality of partition walls extended in the second direction are arranged in parallel between the first and second substrates and a phosphor is coated between the adjacent partition walls.

9. The flat plasma discharge display device according to claim 1, wherein a stripe-shaped shielding layer for shielding emission of unnecessary electromagnetic waves and ultraviolet rays is restrictedly formed on a surface opposite to the second discharge maintaining electrodes.

* * * * *